US011759670B2

(12) United States Patent
Hsu et al.

(10) Patent No.: US 11,759,670 B2
(45) Date of Patent: Sep. 19, 2023

(54) BARBELL SUPPORT ASSEMBLY

(71) Applicant: Fitness Authority Industrial CO., LTD., Taichung (TW)

(72) Inventors: You-Hsiang Hsu, Taichung (TW); Yu-Chun Huang, Taichung (TW)

(73) Assignee: FITNESS AUTHORITY INDUSTRIAL CO., LTD., Taichung (TW)

( * ) Notice: Subject to any disclaimer, the term of this patent is extended or adjusted under 35 U.S.C. 154(b) by 54 days.

(21) Appl. No.: 17/559,336

(22) Filed: Dec. 22, 2021

(65) Prior Publication Data

US 2023/0191186 A1 Jun. 22, 2023

(51) Int. Cl.
*A63B 21/078* (2006.01)
*A63B 21/072* (2006.01)

(52) U.S. Cl.
CPC ..... *A63B 21/078* (2013.01); *A63B 21/0724* (2013.01)

(58) Field of Classification Search
CPC ..... A63B 21/0724; A63B 21/078; A63B 21/0783
See application file for complete search history.

(56) References Cited

U.S. PATENT DOCUMENTS 4,928,961 A * 5/1990 Madden ..... A63B 21/4047 482/104
5,509,876 A * 4/1996 Reyes ..... A63B 21/078 482/104
5,954,619 A * 9/1999 Petrone ..... A63B 71/0036 482/106
6,447,433 B1 * 9/2002 Reyes ..... A63B 21/078 482/104
9,597,539 B2 * 3/2017 Grider ..... A63B 21/00047
9,827,460 B2 * 11/2017 Staten ..... A63B 21/062
9,884,239 B2 * 2/2018 Kay ..... A63B 71/0054
10,226,660 B2 * 3/2019 Wilkins ..... A63B 21/078
10,807,834 B2 * 10/2020 Friessen ..... B66C 1/26
10,953,265 B2 * 3/2021 Aasa ..... A63B 21/0783
10,974,091 B1 * 4/2021 Hensler ..... A63B 21/062
11,406,862 B2 * 8/2022 Downing ..... A63B 21/0783
2013/0296143 A1 * 11/2013 Staten ..... A63B 21/078 482/98
2014/0121073 A1 * 5/2014 Hardy ..... A63B 21/078 482/104
2016/0101310 A1 * 4/2016 Staten ..... A63B 21/16 482/98

* cited by examiner

*Primary Examiner* — Joshua Lee
(74) *Attorney, Agent, or Firm* — Muncy, Geissler, Olds & Lowe, P.C.

(57) ABSTRACT

A barbell support assembly is provided, including: a base; a support arm, including a connection section and a hook section connected with a first end of the connection section, the connection section being rotatably connected to the base and swingable between a first position and a second position, the hook section defining a hooking space; and a restoration unit, connected with a second end of the connection section, biasing the support arm toward the first position; when a rod of a barbell is received within the hooking space, the barbell drives the support arm to move from the first position to the second position, and when the rod of the barbell is removed from the support arm, the restoration unit forces the support arm to return to the first position.

4 Claims, 7 Drawing Sheets

BARBELL SUPPORT ASSEMBLY

BACKGROUND OF THE INVENTION

Field of the Invention

The present invention relates to a barbell support assembly.

Description of the Prior Art

Weight training is for training muscle strength, thereby exercising muscle endurance, strengthening muscle fibers and embellishing body shape. Barbells are usually used in weight training.

Weight training with the barbell, various training actions can be performed for different muscles, such as hard lifts, bench presses, squats, presses or the like. Usually, the barbell is supported on a barbell support. The position in which the barbell is supported on the barbell support can be adjusted according to the user's statures.

However, the conventional barbell support has a supporting member which is not forwardly-backwardly movable so that the user has to move backwardly to shift the barbell away from the supporting member when lifting the barbell from the supporting member, which is inconvenient to use.

After training, the user has to move forwardly to let the rod of the barbell correspond to the supporting member and then places the barbell onto the supporting member, which is inconvenient and dangerous.

The present invention is, therefore, arisen to obviate or at least mitigate the above-mentioned disadvantages.

SUMMARY OF THE INVENTION

The main object of the present invention is to provide a barbell support assembly which facilitates the user to take off a barbell therefrom or put back the barbell thereon easily and safely.

To achieve the above and other objects, a barbell support assembly is provided, including: a base, configured to be mounted on a support; a support arm, including a connection section and a hook section, the connection section being rotatably connected to the base and swingable between a first position and a second position, the hook section being connected with a first end of the connection section, the hook section defining a hooking space configured to receive a rod of a barbell; and a restoration unit, connected with a second end of the connection section, biasing the support arm toward the first position; wherein a position in which the support arm is located when the rod of the barbell is located out of the hooking space is defined as the first position, when the rod of the barbell is received within the hooking space, the barbell drives the support arm to move from the first position to the second position, and when the rod of the barbell is removed from the support arm, the restoration unit forces the support arm to return to the first position.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
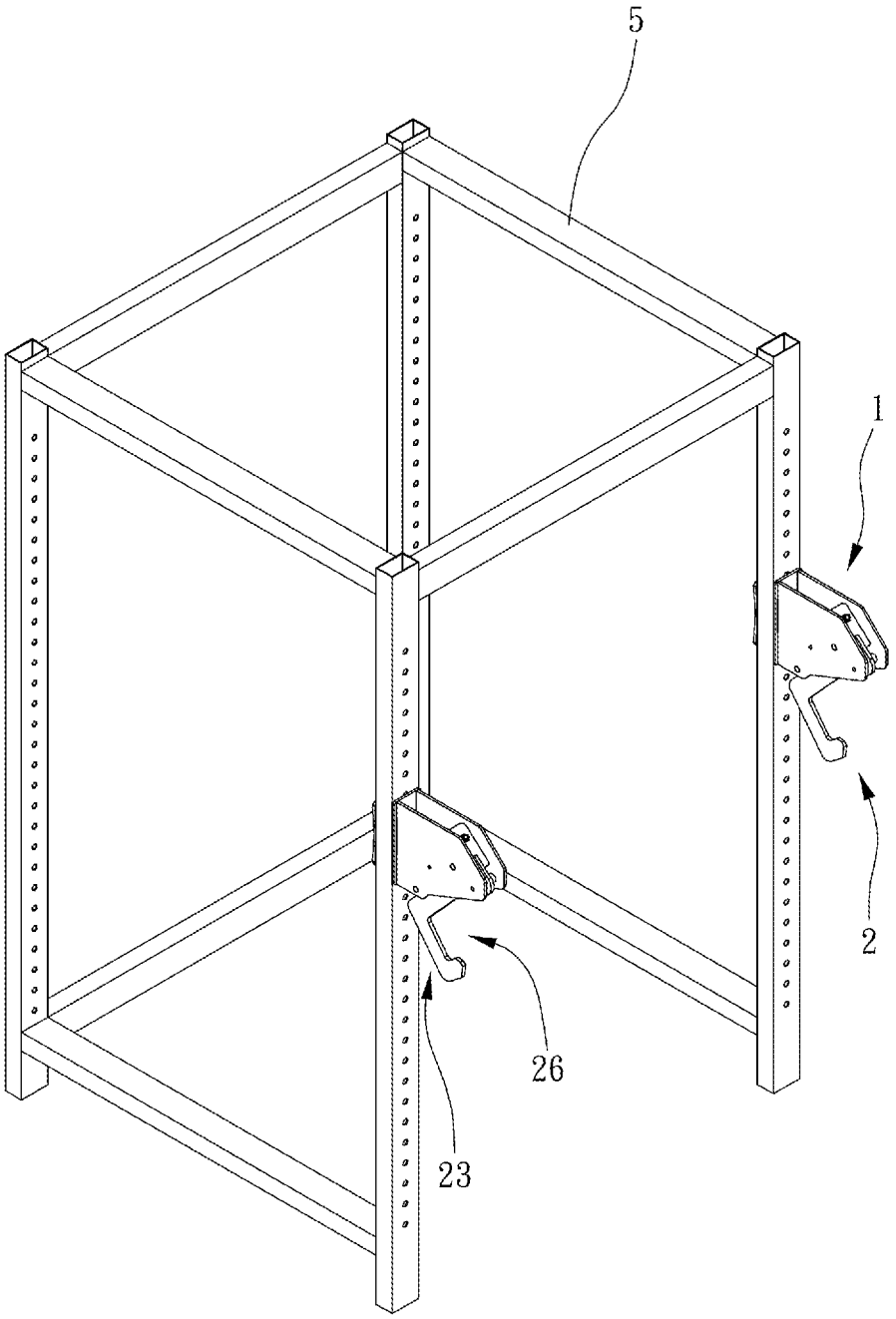
FIG. 1 is a stereogram of a barbell support assembly according to a preferable embodiment of the present invention.
Figure 2:
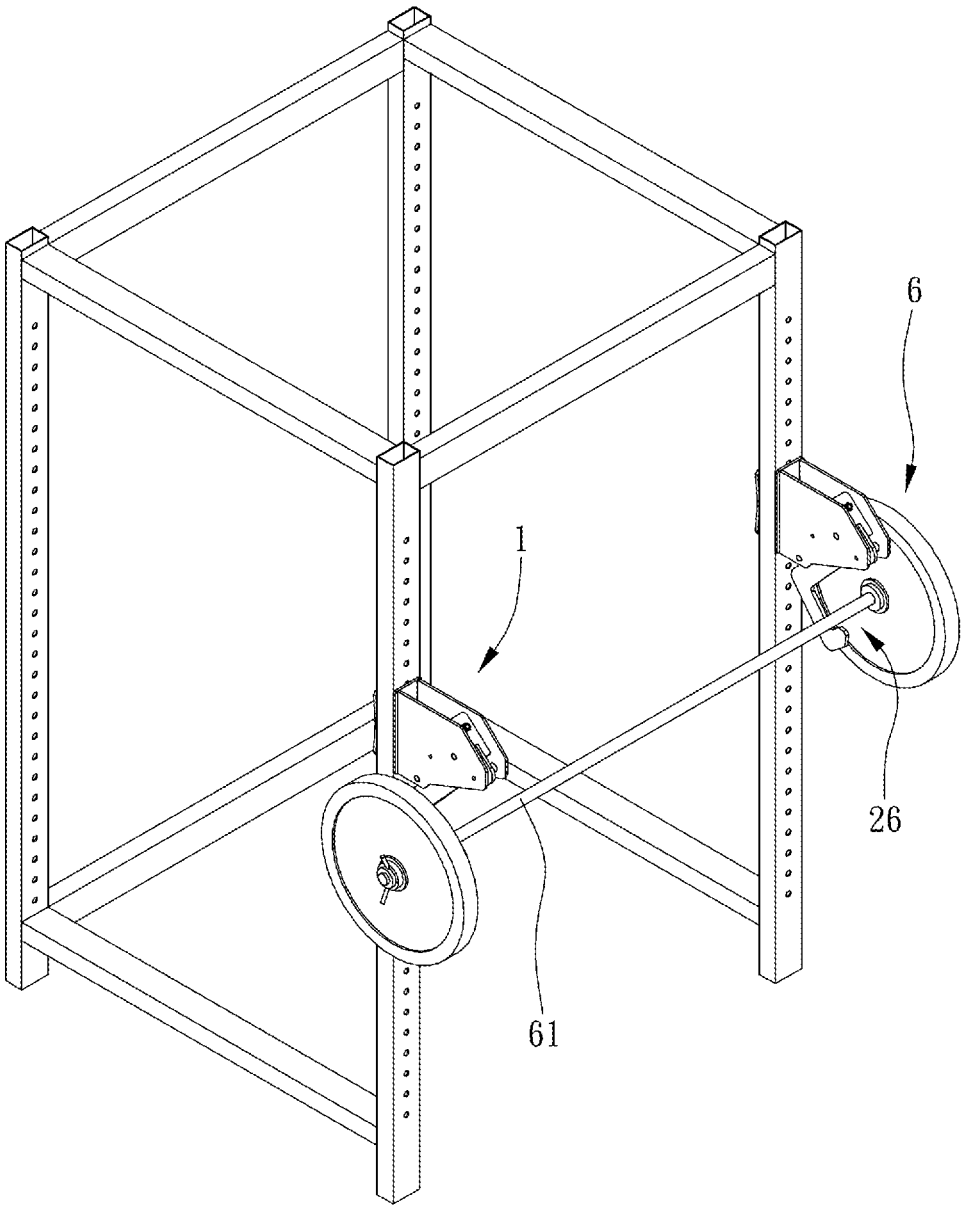
FIG. 2 is a stereogram of the barbell support assembly with a barbell disposed thereon according to a preferable embodiment of the present invention.
Figure 3:
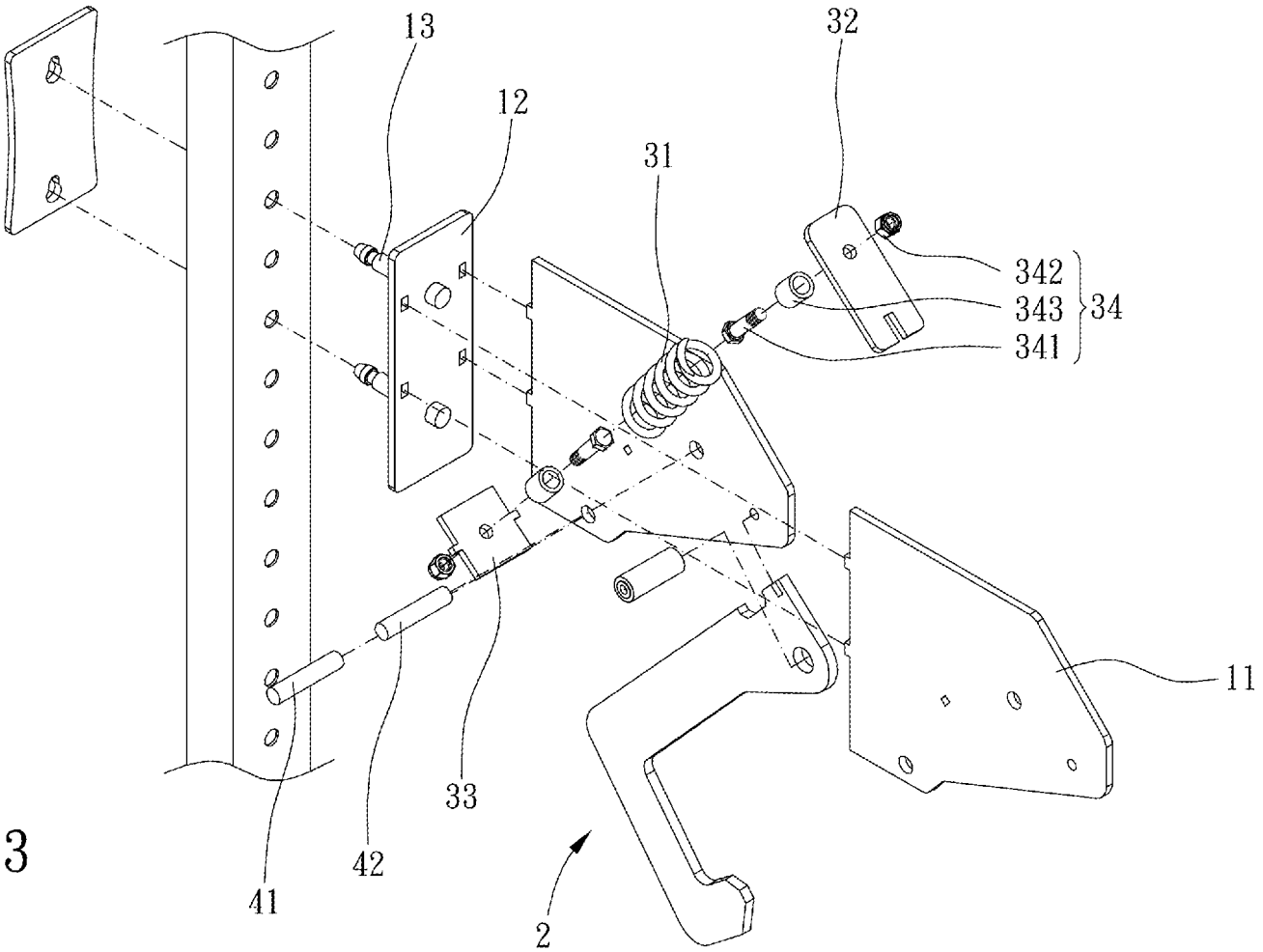
FIG. 3 is a breakdown drawing of a preferable embodiment of the present invention.
Figure 4:
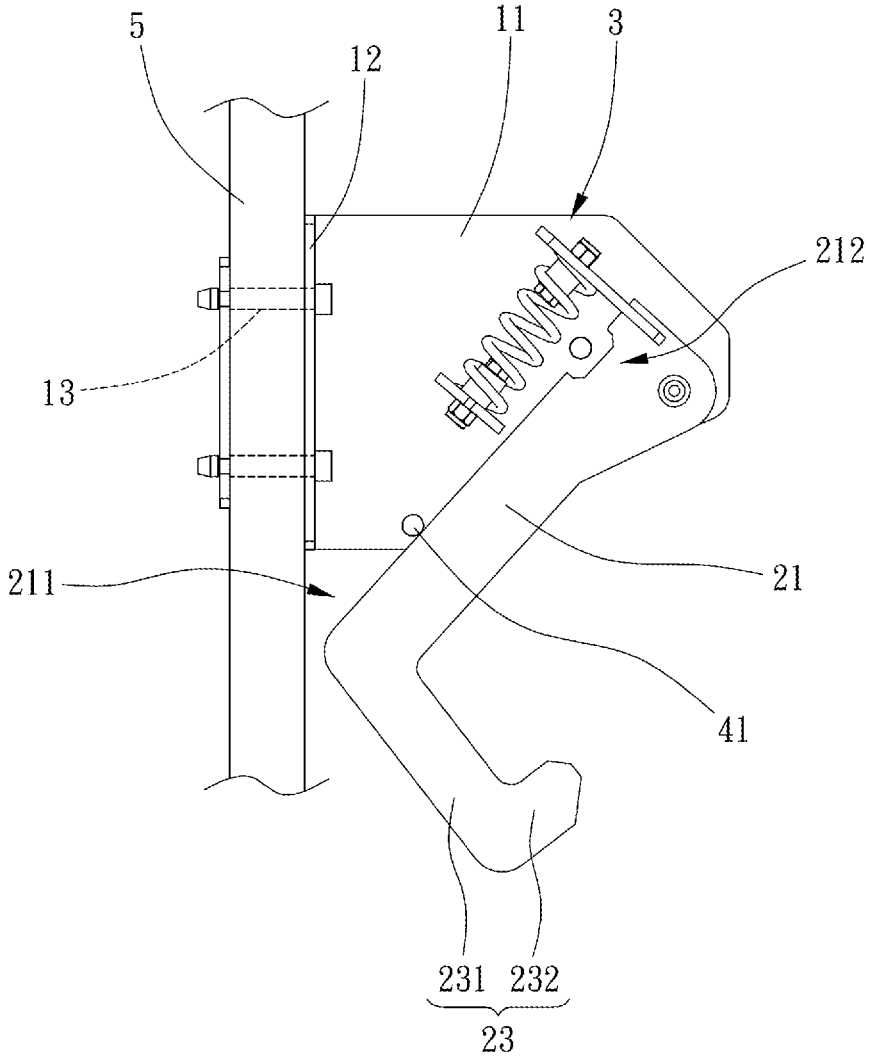
FIG. 4 is a partial enlarged of FIG. 1.
Figure 5:
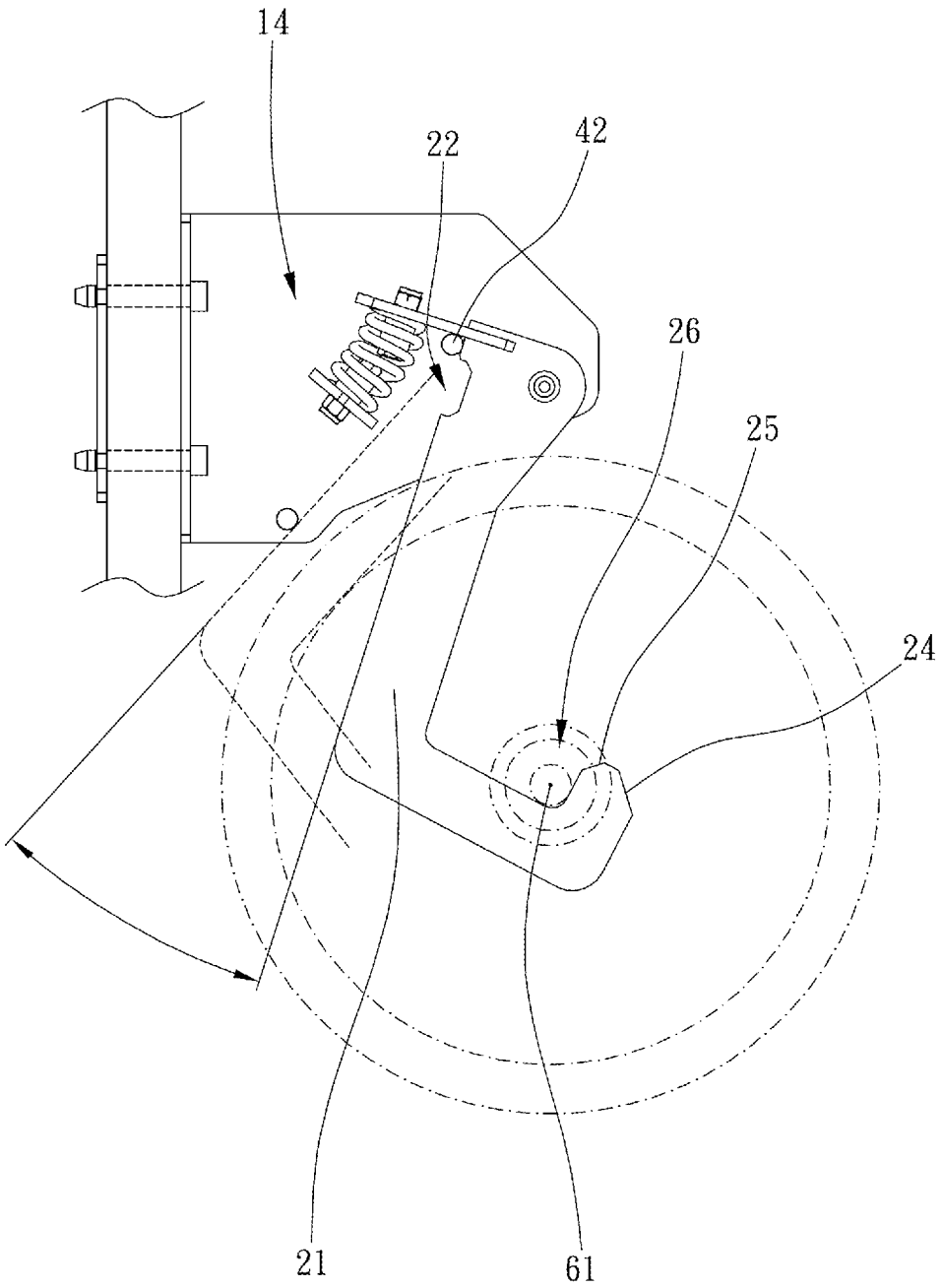
FIG. 5 is a partial enlarged of FIG. 2.
Figure 6:
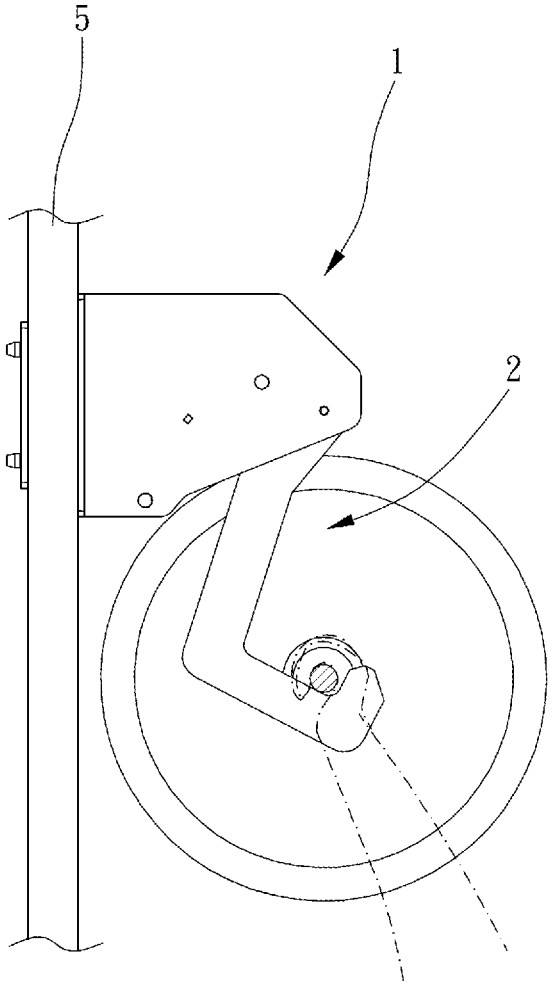
FIGS. 6 and 7 are drawings showing operation of a preferable embodiment of the present invention.
Figure 7:
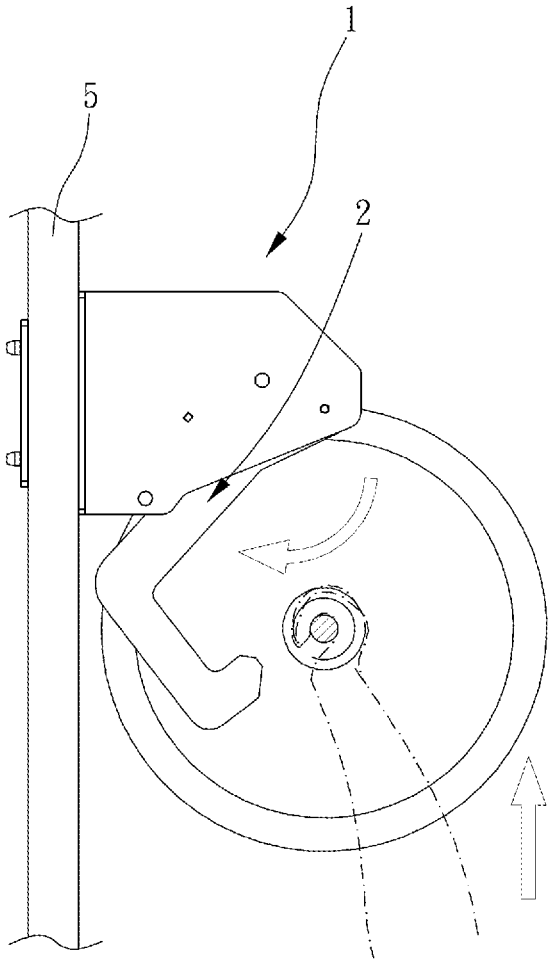

Please refer to FIGS. 1 to 7 for a preferable embodiment of the present invention. A barbell support assembly 1 of the present invention includes a base 1, a support arm 2 and a restoration unit 3.

The base 1 is configured to be mounted on a support 5. The support arm 2 includes a connection section 21 and a hook section 23, the connection section 21 is rotatably connected to the base 1 and swingable between a first position and a second position, the hook section 23 is connected with a first end 211 of the connection section 21, and the hook section 23 defines a hooking space 26 configured to receive a rod 61 of a barbell 6.

The restoration unit 3 is connected with a second end 212 of the connection section 21 and biases the support arm 2 toward the first position. A position in which the support arm 2 is located when the rod 61 of the barbell 6 is located out of the hooking space 26 is defined as the first position. When the rod 61 of the barbell 6 is received within the hooking space 26, the barbell 6 drives the support arm 2 to move from the first position to the second position, and when the rod 61 of the barbell 6 is removed from the support arm 2, the restoration unit 3 forces the support arm 2 to return to the first position.

As the barbell 6 is lifted, the support arm 2 returns to the first position automatically so that the hook section 23 moves away the rod 61 of the barbell 6, which avoids interference of the support arm 2 with the barbell 6. As a result, in training exercise such as squat, it can improve the stability and safety of the exercise, and can prevent the user from falling down due to instability of the center of gravity during the forward and backward movement. Because of the fixed-point lifting training, the user's position will not be significantly shifted from the support arm 2. Therefore, the user can more accurately evaluate the spatial position of the hook section 23, and can reliably change the position of the hook section 23, so that it is easy and safe to put the barbell 6 back to the support arm 2.

In this embodiment, the connection section 21 is swingable between the first position and the second position within a swinging angle between 20 degrees to 40 degrees, for providing a sufficient operation range. The base 1 includes two boards 11, a plate 12 and two pins 13. The two boards 11 are arranged at two sides of the plate 12 in parallel, the two boards 11 and the plate 12 define an internal space 14, and the two pins 13 are connected to and protrusive from a side of the plate 12 facing away the two boards 11. The base 1 is adjustably positioned to the support 5 by the two pins 13, which provides adjustments for various statures. The second end 212 of the connection section 21 extends within the internal space 14 and is rotatably connected with the two boards 11. When the first end 211 of the connection section 21 is in the first position, it is closer to the support 5 than in the second position.

The restoration unit 3 may be a counterweight, and the support arm 2 can returns to the first position by the moment of force. In this embodiment, the restoration unit 3 is received within the internal space 14 and positioned to the two boards 11 so that the restoration unit 3 is prevented from external interferences and ensures good operation of the restoration unit 3.

Specifically, the restoration unit 3 is connected with the base 1 and the second end 212 of the connection section 21, the restoration unit 3 includes a spring 31, the spring 31 may be a coil spring, and the support arm 2 can be biased to return by the spring 31.

In this embodiment, the spring 31 is coil spring, and the restoration unit 3 further includes a first press member 32, a second press member 33 and two shaft assemblies 34. The second press member 33 is positioned to the base 1, an end of the first press member 32 is positioned to the second end 212 of the connection section 21. With the first press member 32 and a second press member 33, the spring 31 can be pressed more stably. One of the two shaft assemblies 34 is positioned to the second press member 33, and the other of the two shaft assemblies 34 is positioned to another end of the first press member 32. Two ends of the spring 31 are respectively disposed around the two shaft assemblies 34 so that the spring 31 can acts and functions more stable. When the support arm 2 moves from the first position toward the second position, the first press member 32 moves toward the second press member 33 and presses the spring 31. In this embodiment, each of the two shaft assemblies 34 includes a bolt 341, a nut 342 and a sleeve 343, the bolt 341 is disposed through the first press member 32 or the second press member 33 and connected with the nut 342, the sleeve 343 is disposed around the bolt 341, and the spring 31 is disposed around the sleeve 343.

Preferably, the barbell support assembly further includes a first blocking member 41, and the first blocking member 41 is disposed on the base 1 and located on a path along which the connection section 21 swings. When the support arm 2 is located in the first position, the first blocking member 41 blocks the first end 211 of the connection section 21, which can control the position of the support arm 2 more precisely. Preferably, the barbell support assembly further includes a second blocking member 42, the second blocking member 42 and the first blocking member 41 are arranged on the base 1 in interval, and the second blocking member 42 is located on a path along which the connection section 21 swings. When the support arm 2 is located in the second position, the second blocking member 42 blocks the second end 212 of the connection section 21.

In this embodiment, the connection section 21 extends straightly, and an extending line from the first blocking member 41 and the second blocking member 42 is parallel to the connection section 21. The second end 212 of the connection section 21 includes a recess 22, and when the first end 211 of the connection section 21 is abutted against the first blocking member 41, a part of the second blocking member 42 extends within the recess 22. The recess 22 is preferably tapered toward a bottom of the recess 22, which provides a large opening for the second blocking member 42 to pass through.

The hook section 23 includes a straight portion 231 and a protrusive portion 232, an end of the straight portion 231 is lateral and connected to the connection section 21, and the protrusive portion 232 is laterally protrusive from another end of the straight portion 231 to define the hooking space 26. The straight portion 231 and the connection section 21 form an obtuse included angle therebetween, for easy disposal of the rod 61; the straight portion 231 and the protrusive portion 232 form an acute angle therebetween, so that the rod 61 can be stably held when the rod 61 moves because of the gravity.

Preferably, an end of the protrusive portion 232 remote from the straight portion 231 includes a first inclined surface 24 and a second inclined surface 25 arranged oppositely, the first inclined surface 24 faces away the connection section 21, the second inclined surface 25 faces the connection section 21 and extends in a direction directed toward the hooking space 26, and the first inclined surface 24 and the second inclined surface 25 are not parallel to each other. When the rod 61 is disposed into the hooking space 26, the rod 61 can be guided, along the first inclined surface 24, to move upward to a top surface of the protrusive portion 232, and the rod 61 is then guided, along the second inclined surface 25, into the hooking space 26.

Preferably, an area of the first inclined surface 24 is larger than an area of the second inclined surface 25, which provides good and stable support for the rod 61.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A barbell support assembly, including:

a base configured to be mounted on a support;

a support army including a connection section and a hook section, the connection section being rotatably connected to the base and swingable between a first position and a second position, the hook section being connected with a first end of the connection section, the hook section defining a hooking space configured to receive a rod of a barbell; and a restoration unity connected with a second end of the connection section, biasing the support arm toward the first position;

wherein a position in which the support arm is located when the rod of the barbell is located out of the hooking space is defined as the first position, wherein when the rod of the barbell is received within the hooking space, the barbell drives the support arm to move from the first position to the second position, and wherein when the rod of the barbell is removed from the support arm, the restoration unit forces the support arm to return to the first position;

wherein the restoration unit is connected with the base and the second end of the connection section;

wherein the restoration unit includes a spring;

wherein the spring is a coil spring;

wherein: the restoration unit further includes a first press member, a second press member and two shaft assemblies, the second press member is positioned to the base, an end of the first press member is positioned to the second end of the connection section, one of the two shaft assemblies is positioned to the second press member, the other of the two shaft assemblies is positioned to another end of the first press member, two ends of the spring are respectively disposed around the two shaft assemblies; and when the support arm moves from the first position toward the second position, the first press member moves toward the second press member and presses the spring.

2. The barbell support assembly of claim 1, wherein the connection section is swingable between the first position and the second position within a swinging angle between 20 degrees to 40 degrees.

3. The barbell support assembly of claim 1, wherein the connection section is swingable between the first position and the second position within a swinging angle between 20 degrees to 40 degrees; the barbell support assembly further includes a first blocking member and a second blocking member, wherein: the first blocking member is disposed on the base and located on a path along which the connection section swings, when the support arm is located in the first position, the first blocking member blocks the first end of the connection section, the second blocking member and the first blocking member are arranged on the base in interval, the second blocking member is located on a path along which the connection section swings, when the support arm is located in the second position, the second blocking member blocks the second end of the connection section the connection section extends straightly, an extending line from the first blocking member to the second blocking member is parallel to the connection section, the second end of the connection section includes a recess, when the first end of the connection section is abutted against the first blocking member, a part of the second blocking member extends within the recess, the hook section includes a straight portion and a protrusive portion, an end of the straight portion is lateral and connected to the connection section, the protrusive portion is laterally protrusive from another end of the straight portion to define the hooking space, the straight portion and the connection section form an obtuse included angle therebetween, the straight portion and the protrusive portion form an acute angle therebetween, an end of the protrusive portion remote from the straight portion includes a first inclined surface and a second inclined surface arranged oppositely, the first inclined surface faces away from the connection section, the second inclined surface faces the connection section and extends in a direction directed toward the hooking space, the first inclined surface and the second inclined surface are not parallel to each other, an area of the first inclined surface is larger than an area of the second inclined surface, the recess is tapered toward a bottom of the recess, each of the two shaft assemblies includes a bolt, a nut and a sleeve, the bolt is disposed through the first press member or the second press member and connected with the nut, the sleeve is disposed around the bolt, the spring is disposed around the sleeve, the base includes two boards, a plate and two pins, the two boards are arranged at two sides of the plate in parallel, the two boards and the plate define an internal space, the two pins are connected to and protrusive from a side of the plate facing away the two boards, the base is adjustably positioned to the support by the two pins, the second end of the connection section extends within the internal space and is rotatably connected with the two boards, the restoration unit is received within the internal space and positioned to the two boards, and when the first end of the connection section is in the first position, it is closer to the support than in the second position.

4. A barbell support assembly, including:

a base configured to be mounted on a support;

a support arm including a connection section and a hook section, the connection section being rotatably connected to the base and swingable between a first position and a second position, the hook section being connected with a first end of the connection section, the hook section defining a hooking space configured to receive a rod of a barbell;

a restoration unit connected with a second end of the connection section, biasing the support arm toward the first position;

a first blocking member; and a second blocking member;

wherein a position in which the support arm is located when the rod of the barbell is located out of the hooking space is defined as the first position, wherein when the rod of the barbell is received within the hooking space, the barbell drives the support arm to move from the first position to the second position, and wherein when the rod of the barbell is removed from the support arm, the restoration unit forces the support arm to return to the first position;

wherein the first blocking member is disposed on the base and located on a path along which the connection section swings, and when the support arm is located in the first position, the first blocking member blocks the first end of the connection section;

wherein: the second blocking member and the first blocking member are arranged on the base in interval, the second blocking member is located on a path along which the connection section swings, and when the support arm is located in the second position, the second blocking member blocks the second end of the connection section;

wherein: the connection section extends straightly, an extending line from the first blocking member to the second blocking member is parallel to the connection section, the second end of the connection section includes a recess, and when the first end of the connection section is abutted against the first blocking member, a part of the second blocking member extends within the recess.

* * * * *